US009301380B2

(12) United States Patent
McGeoch

(10) Patent No.: US 9,301,380 B2
(45) Date of Patent: Mar. 29, 2016

(54) EXTREME ULTRAVIOLET SOURCE WITH MAGNETIC CUSP PLASMA CONTROL

(71) Applicant: PLEX LLC, Fall River, MA (US)

(72) Inventor: Malcolm W. McGeoch, Little Compton, RI (US)

(73) Assignee: PLEX LLC, Fall River, MA (US)

( * ) Notice: Subject to any disclaimer, the term of this patent is extended or adjusted under 35 U.S.C. 154(b) by 0 days.

(21) Appl. No.: 14/852,777

(22) Filed: Sep. 14, 2015

(65) Prior Publication Data

US 2016/0007433 A1 Jan. 7, 2016

Related U.S. Application Data

(62) Division of application No. 14/317,280, filed on Jun. 27, 2014, now Pat. No. 9,155,178.

(51) Int. Cl.
*H05G 2/00* (2006.01)

(52) U.S. Cl.
CPC ..... *H05G 2/003* (2013.01); *H05G 2/008* (2013.01)

(58) Field of Classification Search
USPC ..... 250/504 R
See application file for complete search history.

(56) References Cited

U.S. PATENT DOCUMENTS 3,230,418 A 1/1966 Dandl et al.
3,290,541 A 12/1966 Hertz
7,115,887 B1 10/2006 Hassanein et al.
7,271,401 B2 9/2007 Imai et al.
7,479,646 B2 1/2009 McGeoch
7,671,349 B2 3/2010 Bykanov et al.
7,705,333 B2 4/2010 Komori et al.
7,999,241 B2 8/2011 Nagai et al.
8,143,606 B2 3/2012 Komori et al.
8,198,615 B2 6/2012 Bykanov et al.
8,269,199 B2 9/2012 McGeoch
8,440,988 B2 5/2013 McGeoch
8,492,738 B2 7/2013 Ueno et al.
8,507,883 B2 8/2013 Endo et al.
8,519,366 B2 8/2013 Bykanov et al.
8,530,869 B2 * 9/2013 Nagai ..... G03F 7/70033 250/365
8,569,723 B2 10/2013 Nagai et al.
8,569,724 B2 10/2013 McGeoch
8,586,953 B2 11/2013 Komori et al.
8,586,954 B2 11/2013 Asayama et al.
8,592,788 B1 11/2013 McGeoch
8,629,417 B2 1/2014 Nagai et al.
8,710,475 B2 4/2014 Komori et al.
2005/0205810 A1 * 9/2005 Akins ..... B82Y 10/00 250/504 R
2009/0314967 A1 * 12/2009 Moriya ..... G03F 7/70191 250/504 R (Continued)

OTHER PUBLICATIONS

M. McGeoch, "Progress on the Lithium EUV Source for HVM", Sematech Intl. EUVL Symposium, Toyama, Japan, Oct. 6-10, 2013, pp. 1-56.

(Continued)

*Primary Examiner* — Kiet T Nguyen
(74) *Attorney, Agent, or Firm* — Wolf, Greenfield & Sacks, P.C.

(57) ABSTRACT

A laser-produced plasma extreme ultraviolet source has a buffer gas to slow ions down and thermalize them in a low temperature plasma. The plasma is initially trapped in a symmetrical cusp magnetic field configuration with a low magnetic field barrier to radial motion. Plasma overflows in a full range of radial directions and is conducted by radial field lines to a large area annular array of beam dumps.

10 Claims, 12 Drawing Sheets

(56) References Cited

U.S. PATENT DOCUMENTS

| | | | |
|---|---|---|---|
| 2010/0090133 | A1 | 4/2010 | Endo et al. |
| 2010/0181503 | A1 | 7/2010 | Yanagida et al. |
| 2011/0170079 | A1 | 7/2011 | Banine et al. |
| 2011/0284775 | A1 | 11/2011 | Ueno et al. |
| 2012/0305810 | A1 | 12/2012 | Ershov et al. |
| 2012/0313016 | A1 | 12/2012 | Fleurov et al. |
| 2014/0021376 | A1 | 1/2014 | Komori et al. |

OTHER PUBLICATIONS

M. Richardson et al., "High conversion efficiency mass-limited Sn-based laser plasma source for extreme ultraviolet lithography", J. Vac. Sci. Tech. B, vol. 22, No. 2, Mar./Apr. 2004, pp. 785-790.

Y. Shimada et al., "Characterization of extreme ultraviolet emission from laser-produced spherical tin plasma generated with multiple laser beams", Appl. Phys. Lett., 86, 051501 (2005).

S. Fujioka et al., "Opacity Effect on Extreme Ultraviolet Radiation from Laser-Produced Tin Plasmas", Phys. Rev. Lett., 95, 235004 (2005).

S. Fujioka et al., "Pure-tin microdroplets irradiated with double laser pulses for efficient and minimum-mass extreme-ultraviolet light source production", Appl. Phys, Lett. 92, 241502 (2008).

H. Mizoguchi et al., "Sub-hundred Watt operation demonstration of HVM LPP-EUV Source", Proc. Of SPIE, vol. 9048, 90480D-1, 2014.

D.C. Brandt et al., "LPP EUV Source Readiness for NXE 3300B", Proc. of SPIE, vol. 9048, 90480C-1, 2014.

S.S. Harilal et al., "Confinement and dynamics of laser-produced plasma expanding across a transverse magnetic field", Phys. Rev. E 69, 026413 (2104).

S.S. Harilal et al., "Ion debris mitigation from tin plasma using ambient gas, magnetic field and combined effects", Appl., Phys., B 86, 547-553 (2007).

M. McGeoch, "Test of an argon cusp plasma for tin LPP power scaling", Proc. of SPIE, vol. 9422, 942228-1, 2015, 6 pages.

Search Report and Written Opinion of the International Searching Authority dated Sep. 23, 2015 from corresponding International Application No. PCT/US2015/037395.

* cited by examiner

EXTREME ULTRAVIOLET SOURCE WITH MAGNETIC CUSP PLASMA CONTROL

CROSS-REFERENCE TO RELATED APPLICATIONS

The present application is a divisional of U.S. patent application Ser. No. 14/317,280 entitled "EXTREME ULTRAVIOLET SOURCE WITH MAGNETIC CUSP PLASMA CONTROL", filed on Jun. 27, 2014, which is hereby incorporated by reference in its entirety.

FIELD OF THE INVENTION

This invention relates to the production of extreme ultraviolet (EUV) light especially at 13.5 nm for lithography of semiconductor chips. Specifically it describes configurations of the laser-produced-plasma (LPP) light source type that have increased plasma heat removal for scaling to ultimate power.

BACKGROUND OF THE INVENTION

There is a need for more powerful sources of extreme ultraviolet (EUV) light at 13.5 nm in order to increase the throughput of semiconductor patterning via the process of EUV Lithography. Many different source designs have been proposed and tested (see historical summary for background [1]) including the highly efficient (up to 30%) direct discharge (DPP) lithium approach [2,3,4,5,6,7] and also laser-plasma (LPP) irradiation of ting containing [8] or pure tin droplets [9,10,11]. Laser irradiation of tin droplets has been the subject of intensive recent development [12,13], particularly in the pre-pulse variant [11], which has a demonstrated efficiency of 4% and a theoretical efficiency of up to 6%.

In both lithium DPP and tin LPP approaches it is necessary to keep metal atoms from condensing on the collection mirror that faces the EUV-emitting plasma. Also, in the tin LPP approach, but not with lithium DPP, there are fast ions ranging up to 5 keV that have to be stopped otherwise the collection mirror suffers sputter erosion. The design of a successful EUV source based on a metal vapor must strictly protect against deposition on the collector of even 1 nm of metal in days and weeks of operation, and this factor provides the most critical constraint on all of the physics that can occur in a high power source. In the case of lithium, extremely thorough metal vapor containment is provided via a buffer gas heat pipe [2]. However, the heat pipe containment technology cannot be extended to tin sources because the heat pipe temperature would have to be 1300 C to provide the equivalent tin vapor pressure versus 750 C for lithium. This vastly higher working temperature renders the heat pipe approach essentially unworkable for tin whereas it is very practicable for lithium.

Harilal et al. [14,15] have performed a series of studies on the use with a tin LPP source of either a magnetic field, a buffer gas, or a combination of these to slow down fast ions and protect the collection optic. Many magnetic field configurations have been discussed [16-29], with and without a buffer gas, to trap and exhaust tin ions. Methods have been proposed [30,31] to further ionize tin atoms so that they may be controlled by an applied magnetic field. The symmetrical magnetic mirror trap [18] has a long axial exhaust path for tin ions and if this path has a shallow gradient of magnetic field, can suffer from a build-up of plasma density as successive tin droplets are irradiated. Two things begin to go wrong: 1) there is an EUV absorption cross section of $2\times10^{-17}$ cm$^2$ for tin atoms that causes increasing EUV absorption loss as the plasma density builds, and 2) the mirror magnetic trap is unstable [14] to lateral plasma loss, which can expose the collection optic to tin atoms. Refinements of the mirror trap have been described [20,23] in which an asymmetry is introduced so that plasma flow is toward a weaker magnetic field at one end of the mirror configuration. This also can be combined with an electric field [20] to aid plasma extraction at the end with lower magnetic field. However, only a relatively constricted path is available for plasma exhaust toward one end of such a trap configuration, implying a limited heat removal capacity. Other magnetic configurations [27,29] have been designed to protect the collection optic, but these rely on gas cooling, and do not provide a specific path for plasma flow toward a large area plasma beam dump. Accordingly, the power scaling of such configurations is limited due to lack of heat removal.

Buffer gases have been discussed [15,32,33] to reduce ion energy and protect the collection optic. One of the main buffer gases used has been hydrogen [13,33] but as plasma power increases there is an increasing fraction of molecular hydrogen dissociation that can lead to vacuum pumping and handling problems of reactive hydrogen radicals. Coolant gases with more favorable properties, in that they do not react chemically, are argon and helium. These gases have higher EUV absorption than hydrogen [15], so they may only be used at lower density. However, argon has substantial stopping power for fast tin ions [15], and is particularly effective when a magnetic field is combined with a gas buffer to lengthen the path of tin ions via curvature in the field.

SUMMARY OF THE INVENTION

It is an object of the present invention to provide a symmetric cusp magnetic field within the EUV source to allow a higher power to be handled than in prior art. The symmetric cusp field is characterized by having equal opposed inner coils that establish strong opposed axial magnetic fields and a zero field point at the mid-position between them. Off axis, the radial magnetic field is weaker than the axial magnetic fields, so that plasma leakage occurs radially toward an annular beam dump location. Outer coils maintain a guiding field for plasma to deliver it to the annular beam dump. Several features of this geometry allow high power handling:

1) There is stable plasma containment at the center of the cusp;
2) There is controlled plasma outflow at the equatorial magnetic field minimum of the cusp;
3) The plasma outflow is guided by the radial magnetic field onto an annular plasma beam dump that can have a large area, maximizing the power that can be handled.

This design incorporates an inflow of buffer gas, preferably argon, that serves the following purposes:

1) Sufficient buffer gas density (approximately 50 mTorr, if argon) degrades the energy of tin ions from the laser-plasma interaction, until they are thermalized at low energy (approximately 1 eV) within the cusp trap;
2) Fresh buffer gas flows past the collection mirror surface to sweep away neutral tin atoms that otherwise would pass through the magnetic field without deflection and deposit on the mirror;
3) The buffer gas within the cusp trap dilutes the tin density via continual replenishment to prevent tin buildup and consequent EUV absorption;
4) The buffer gas plasma outflow from the cusp carries both the tin ions and the vast majority of process heat down pre-determined magnetic field flow lines onto the plasma beam dump. In this it is aided by the large heat capacity of metastable and ionic buffer gas species;

5) Radiation from the trapped buffer gas plasma can provide additional heat loss, this time to the chamber walls and collection optic. Resonance radiation can create buffer gas metastables throughout the chamber that can Penning ionize neutral tin atoms, aiding their collection via the magnetic field;

6) The plasma outflow contributes a powerful vacuum pump action with a well-defined direction toward the plasma beam dump.

Accordingly we propose an extreme ultraviolet light source comprising: a chamber; a source of droplet targets; one or more lasers focused onto the droplets in an interaction region; a flowing buffer gas; one or more reflective collector elements to redirect extreme ultraviolet light to a point on the common collector optical axis which is an exit port of the chamber; an annular array of plasma beam dumps disposed around the collector optical axis; a magnetic field provided by two sets of opposed, symmetrical field coils that carry equal but oppositely directed currents to create a symmetrical magnetic cusp, wherein the laser-plasma interaction takes place at or near the central zero magnetic field point of the cusp and heat is removed via radial plasma flow in a 360 degree angle range perpendicular to the optical axis toward the annular array of plasma beam dumps.

It is a further object of this invention to provide a near-symmetric cusp field for the capture and subsequent guiding toward an annular plasma beam dump of the tin ions and buffer gas ions from a laser-plasma interaction region. We define a "near-symmetric" cusp field as one in which the opposed axial magnetic fields may not be equal, but they both exceed the maximum radial magnetic field, implying that plasma out-flow will not be axial, but will be wholly radial. In the near-symmetric case the zero magnetic field point of the cusp lies between the axial coils and is closer to one of them.

Accordingly we propose an extreme ultraviolet light source comprising: a chamber; a source of droplet targets; one or more lasers focused onto the droplets in an interaction region; a flowing buffer gas; one or more reflective collector elements to redirect extreme ultraviolet light to a point on the common collector optical axis which is an exit port of the chamber; an annular array of plasma beam dumps disposed around the collector optical axis; a magnetic field provided by two sets of opposed, near-symmetrical field coils that carry oppositely directed currents to create a near-symmetrical magnetic cusp, wherein the laser-plasma interaction takes place at or near the zero magnetic field point of the cusp and heat is removed via radial plasma flow in a 360 degree angle range perpendicular to the optical axis toward the annular array of plasma beam dumps.

The present invention thereby integrates, synergistically, an advantageous magnetic field configuration with an effective buffer gas. Consequently, it is anticipated that application of this invention will extend the process power (i.e. the absorbed laser power) to the range of 30 kW and above, generating a usable EUV beam at the exit port of 150 W, or more.

DETAILED DESCRIPTION

Figure 1:
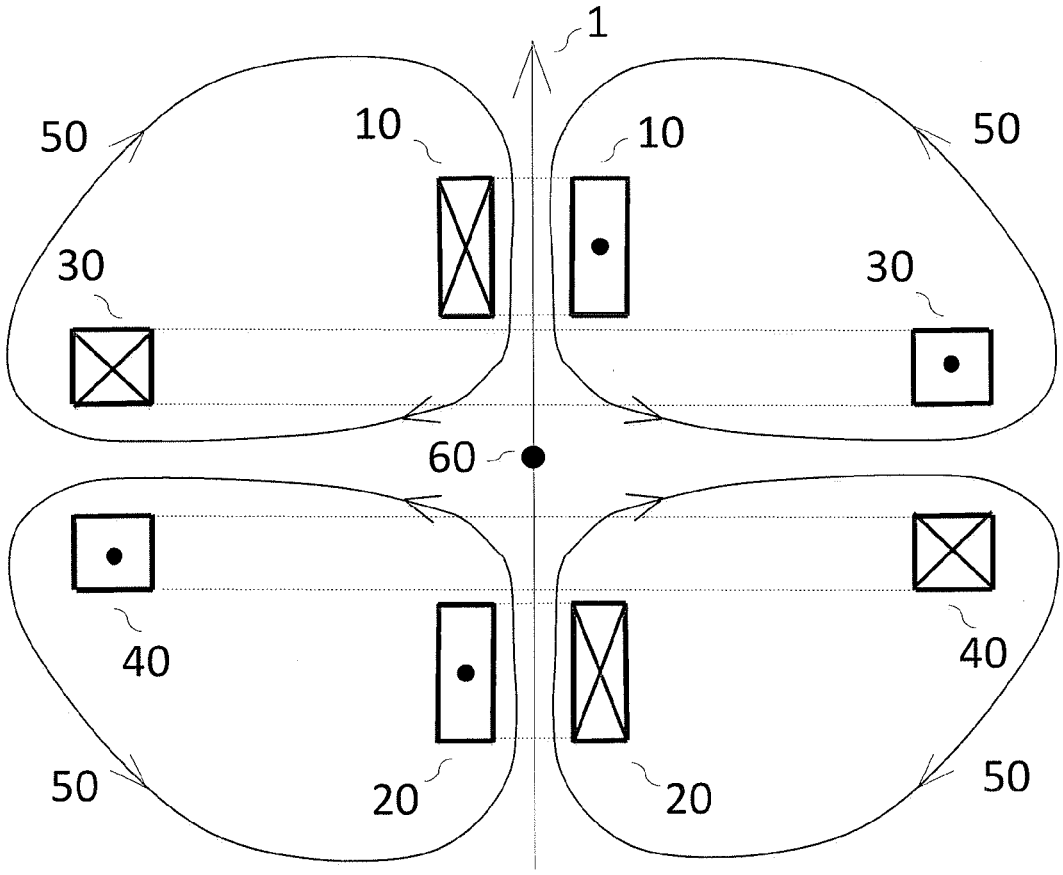
FIG. 1 illustrates the symmetrical cusp magnetic field configuration by itself. The configuration has a vertical axis of rotational symmetry.

Herein the corresponding like elements of different realizations of the invention are labeled similarly across the drawing set, and will not always be listed in their entirety.

We describe the underlying magnetic field configuration in its first, symmetric, embodiment with reference to FIG. 1. The basic cusp configuration of the present invention comprises four circular coils divided into two sets: coils 10 and 30 in the upper half, and coils 20 and 40 in the lower half. In FIG. 1 the coils are shown in cross section. There is a vertical axis 1 of rotational symmetry. Within the cross section of each winding the direction of current flow is shown by a dot for current coming out of the page and an X for current flowing into the page. In the symmetrical cusp equal and opposite currents flow in coils 10 and 20 and they have the same number of turns in their windings. They therefore generate equal and opposite magnetic fields that cancel to zero at central point 60. Additional field shaping is performed by coils 30 and 40. Coil 30 carries a current in the same direction as coil 10, and coil 40 an equal current to coil 30 but in the opposed direction. The final cusp field, indicated by magnetic field lines 50, has a disc shape around its vertical symmetry axis. This shape is designed to channel a radial plasma flow into an annular plasma beam dump as described below.

Figure 2:
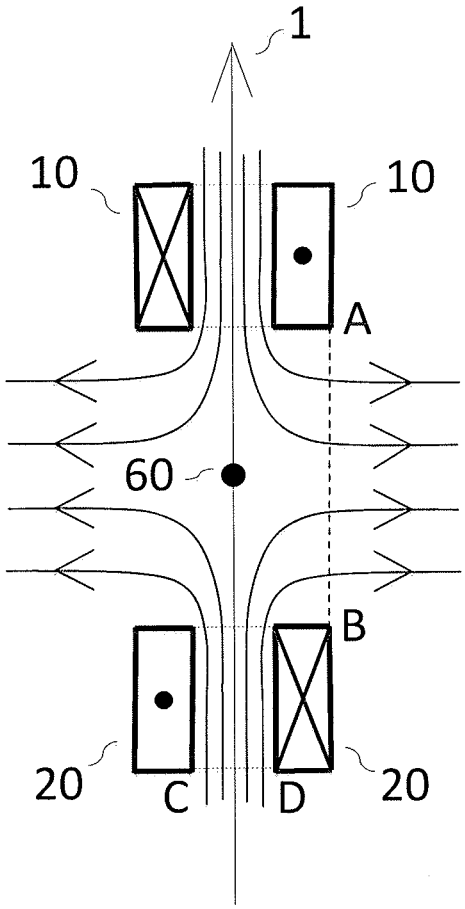
FIG. 2 shows magnetic field lines near the center of the symmetrical cusp configuration of FIG. 1.
Figure 3:
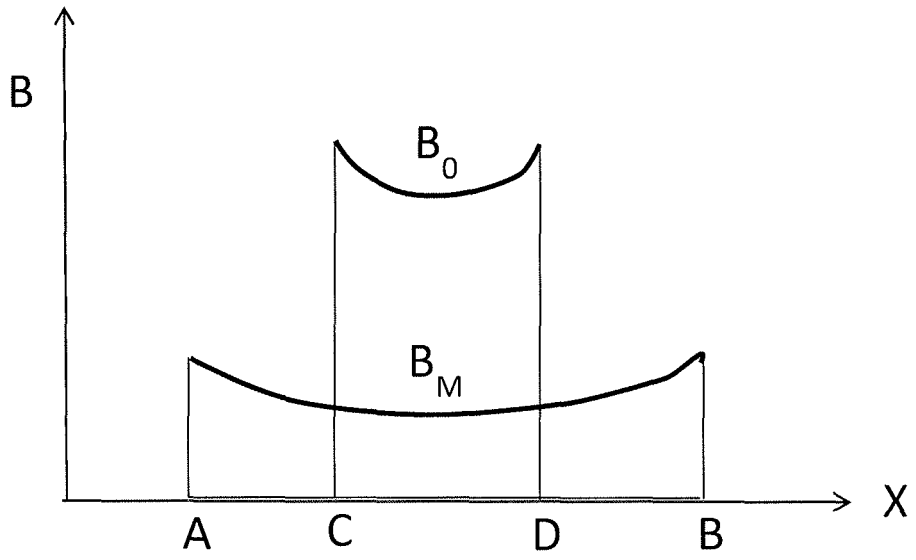
FIG. 3 illustrates the strength of the magnetic field along directions defined with reference to FIG. 2.

More detail on the central region of the cusp is given in FIG. 2. In that figure coils 10 and 20 correspond to those labeled 10 and 20 in FIG. 1. The magnetic field variation along lines AB and CD of FIG. 2 is shown qualitatively in FIG. 3 where X represents distance along the labeled lines. The field within coil 10 or coil 20 has a central value $B_0$ lying on axis 1 between points C and D.

This value $B_0$ exceeds the central value $B_M$ half way between A and B. When the cusp axial field exceeds its radial field in this manner, then plasma leakage dominates at the circle of positions defined by all possible locations of the center of line AB around rotation axis 1. Plasma outflow from this locus then follows radial field lines toward the gap between coils 30 and 40 and enters the annular plasma beam dump.

Figure 4:
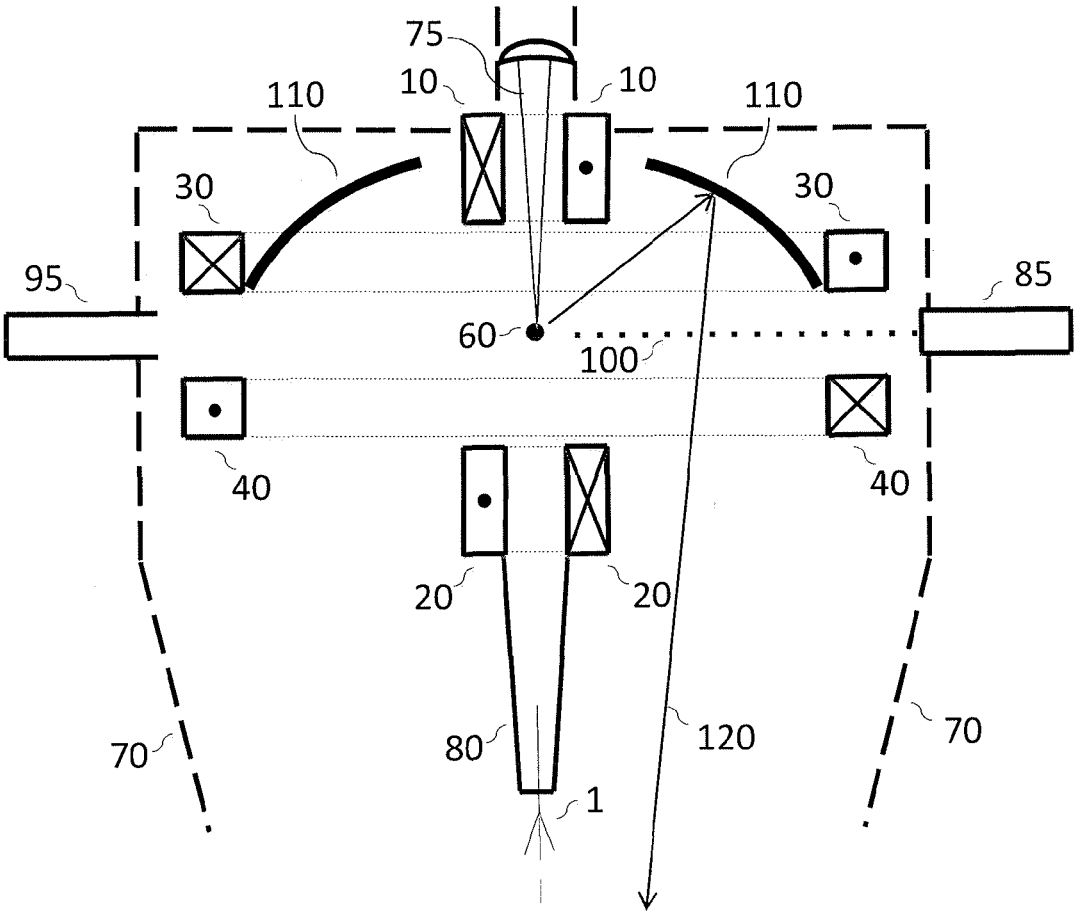
FIG. 4 shows the symmetrical cusp magnetic field coils in relation to the collection optic, the droplet generator, the droplet capture unit, the incident laser beam and the laser beam dump.

With the above description of the cusp field in place, we show in FIG. 4 the disposition of several further elements of the EUV source. The outline of a vacuum chamber 70 is shown, where chamber 70 may surround all of the coil elements, or part of the set of coils. Axis of rotational symmetry 1 defines the symmetry axis of chamber 70. Set into the wall of chamber 70 is droplet source 85 that delivers a stream of material in approximately 20 micron diameter droplets at a high velocity (order of 200 $msec^{-1}$) toward interaction location 60. Droplets that are not used are captured in droplet collector 95 at the opposite side of the chamber. Entering on the chamber axis is a laser beam (or beams) 75 that propagate through the center of coil 10 toward interaction region 60, where laser energy is absorbed by a droplet and highly ionized species emit 13.5 nm EUV light. For example, the $CO_2$ laser at 10.6 micron wavelength has been found to be effective [11] with tin droplets for conversion to EUV energy, with 4% conversion demonstrated into 2% bandwidth light centered at 13.5 nm in $2\pi$ steradians [11]. Laser light that is not absorbed or scattered by a droplet is captured in beam dump 80 attached to coil 20. EUV light emitted from region 60 is reflected by collection optic 110 to propagate as typical ray 120 toward the chamber exit port for EUV. Collection optic 110 has rotational symmetry around axis 1. The chamber is shown truncated at the bottom in FIG. 4, but it continues until reaching the apex of the cone defined by converging walls 70 and rotation axis 1. At that position, known as the "intermediate focus" or IF, the beam of EUV light is transferred from chamber 70 via a port into the vacuum of the stepper machine.

In prior work [11] the laser has been applied as two separate pulses, a pre-pulse and a main pulse, where the pre-pulse evaporates and ionizes the tin droplet and the main pulse heats this plasma ball to create the high ionization states that yield EUV photons. When the pre-pulse is a picosecond laser pulse it ionizes very effectively [12] and creates a uniform pre-plasma to be heated by the main pulse, which is of the order of 10-20 nsec duration. Complete ionization via the pre-pulse is a very important step toward capture of (neutral) tin atoms which, if not ionized, will not be trapped by the magnetic field and could coat the collection optic. The pre-pulse laser may be of different wavelength to the main pulse laser. In addition to magnetic capture of ionized tin in the cusp field, there is also a flowing buffer gas to sweep neutral tin atoms toward the plasma dump, as discussed below.

Figure 5:
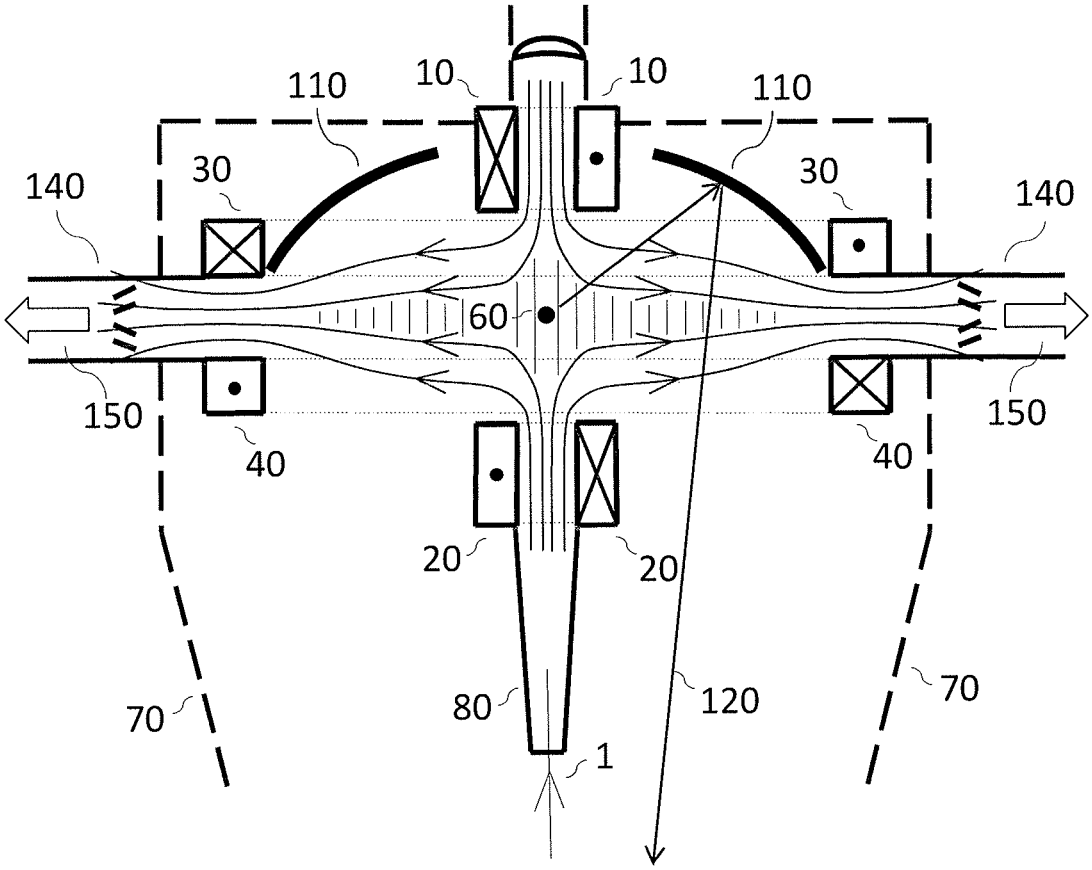
FIG. 5 shows the symmetrical cusp magnetic field coils guiding radial plasma flow toward the annular array of plasma beam dumps and vacuum pumps.

In FIG. 5 we show one embodiment of the invention in which a symmetrical magnetic cusp field guides the plasma (vertically shaded) from interaction region 60 toward plasma beam dumps 140 arranged azimuthally around chamber 70. For clarity in FIG. 5, the droplet generator and droplet capture device are not shown, but instead we show the majority configuration which is an annular plasma beam dump 140 leading into vacuum pumps 150. Smaller items such as the droplet generator and laser beams for droplet measurement are interspersed between the larger plasma dump elements and may be protected from the plasma heat and particle flux by local field-shaping coils or magnetic elements.

In operation, this embodiment has a stream of argon atoms entering for example through the gap between coil 10 and collection optic 110, to establish an argon atom density of approximately $2\times10^{15}$ atoms $cm^{-3}$ in front of collection optic 110. A stream of droplets is directed toward region 60 and irradiated by one or more laser pulses to generate EUV light. Plasma ions from the interaction can have an energy up to 5 keV [14] and are slowed down by collisions with argon atoms at the same time as they are directed in curved paths by the cusp field, with the result that a thermalized plasma, more than 99.9% argon and less than 0.1% tin ions, accumulates in the cusp central region. After a short period of operation (less than $10^{-3}$ sec) the accumulated thermal plasma density, and by implication its pressure, exceeds the pressure of the containment field $B_M$ at the waist of the cusp (discussed above in relation to FIGS. 2 and 3). Plasma then flows toward beam dumps 140 guided by the outer cusp magnetic field. The presence of a plasma flow causes neutral argon atoms to be entrained in the flow, and pumped effectively into beam dumps 140 and vacuum pumps 150. The plasma is more than 99.9% argon when tin droplet size of 20 micron diameter is used at a repetition frequency of 100 kHz. These parameters correspond to $1.5\times10^{19}$ tin atoms per second in the flow, once it has reached steady state. The argon flow at a density of $10^{15}$ $cm^{-3}$, velocity of $1\times10^{5}$ $cmsec^{-1}$ and in a plasma cross-sectional area of 1000 $cm^2$ is $10^{23}$ argon atoms per second, exceeding the tin flow by 6,600 times. It can be seen that the plasma cooling is dominated by argon, with a very minor tin component within the flow.

Figure 6:
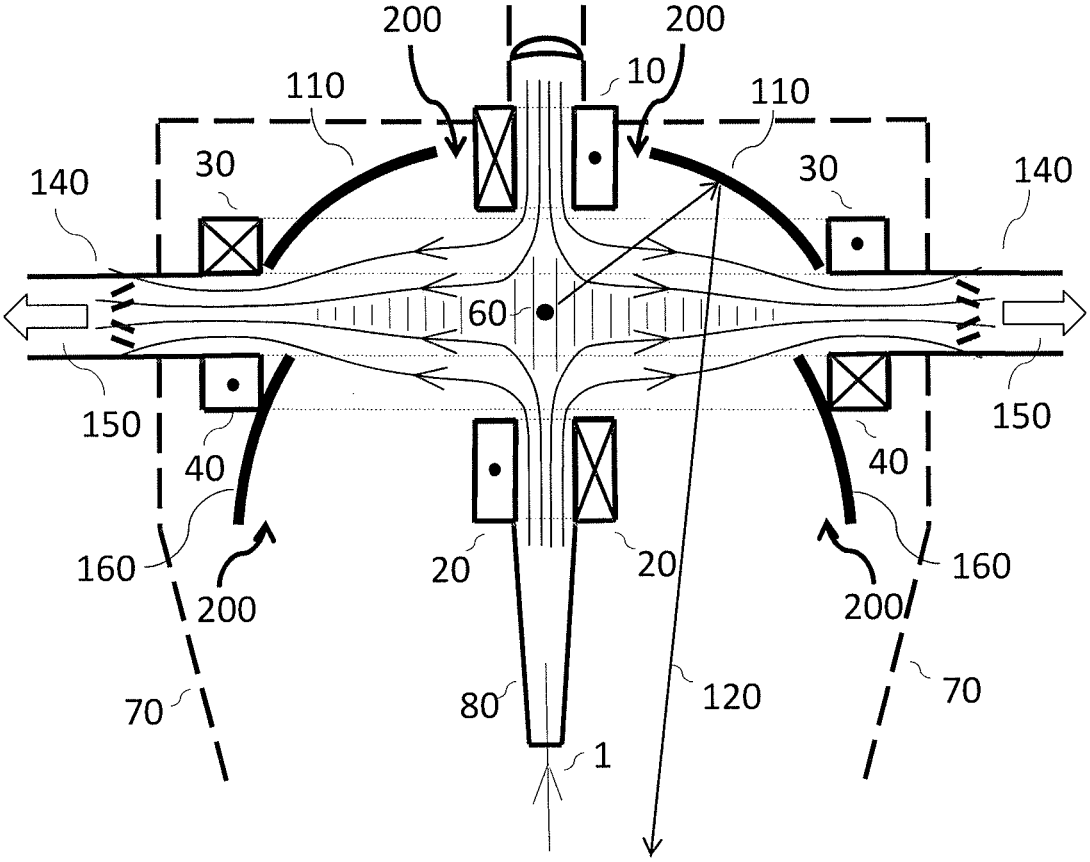
FIG. 6 shows a realization of the invention in which there are two collection optical elements. The figure has a vertical axis of rotational symmetry.

A further embodiment of the invention is shown in FIG. 6 in which two collection optical elements 110 and 160 are deployed, one on either side of the radial plasma flow. Each of 110 and 160 is a surface generated by rotation around vertical symmetry axis 1. They achieve EUV reflectivity of, on average, approximately 50% by means of graded Mo—Si multilayer stacks. Each is protected from neutral tin atoms by a flow of clean argon that enters at positions 200, and ultimately is pumped away via plasma beam dumps 140 and vacuum pumps 150. The large solid angle of the combined collectors will improve source power in circumstances where source size is sufficiently small to be matched to the etendue of the stepper.

Figure 7:
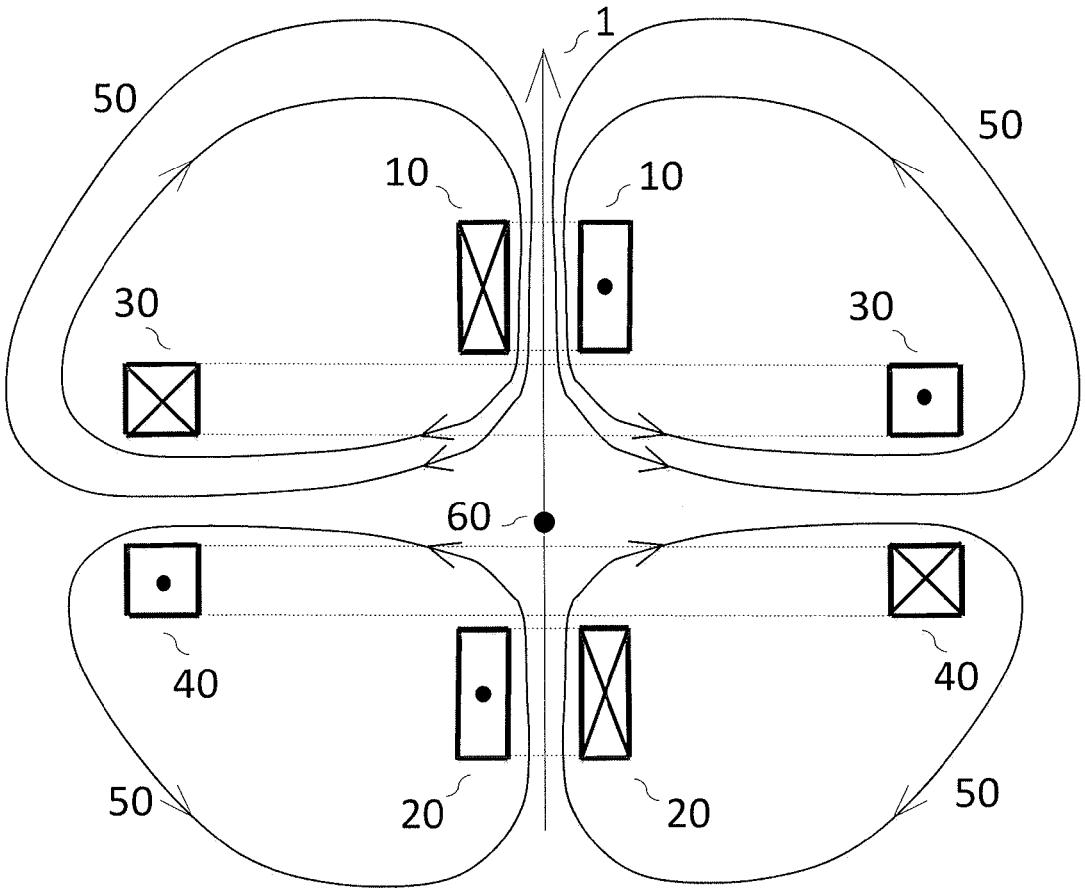
FIG. 7 illustrates the near-symmetrical cusp magnetic field configuration by itself. The configuration has a vertical axis of rotational symmetry.

We describe the underlying magnetic field configuration in its second major, near-symmetric, embodiment with reference to FIG. 7. This configuration comprises four circular coils divided into two sets: coils 10 and 30 in the upper half, and coils 20 and 40 in the lower half. In FIG. 7 the coils are shown in cross section. There is a vertical axis 1 of rotational symmetry. Within the cross section of each winding the direction of current flow is shown by a dot for current coming out of the page and an X for current flowing into the page. In the near-symmetrical cusp opposite but unequal currents flow in coils 10 and 20 when it is considered, for example that they have the same number of turns in their windings. They therefore generate unequal and opposite magnetic fields that cancel to zero at point 60, which is no longer exactly centered between coils 10 and 20. Additional field shaping is performed by coils 30 and 40. Coil 30 carries a current in the same direction as coil 10, and coil 40 a current not equal to that in coil 30 in the opposed direction. The final cusp field, indicated by magnetic field lines 50, has a disc shape around its vertical symmetry axis. This shape is designed to channel a radial plasma flow as described below.

Figure 8:
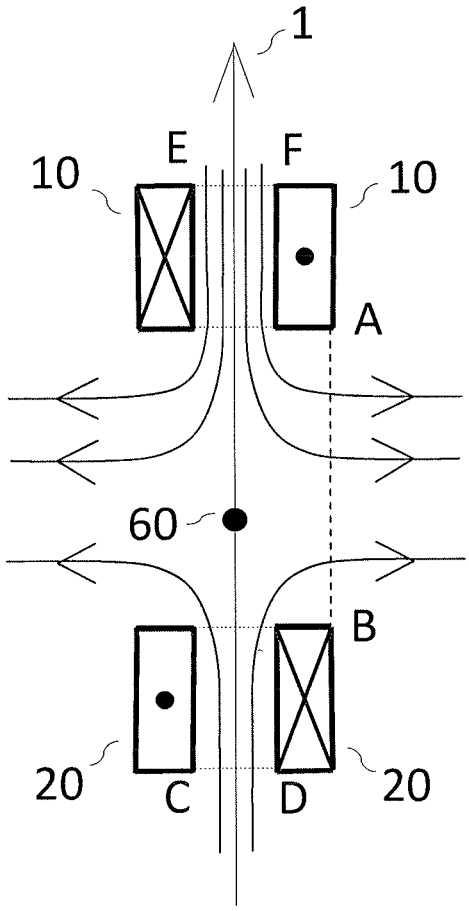
FIG. 8 shows magnetic field lines near the center of the near-symmetrical cusp configuration of FIG. 7.
Figure 9:
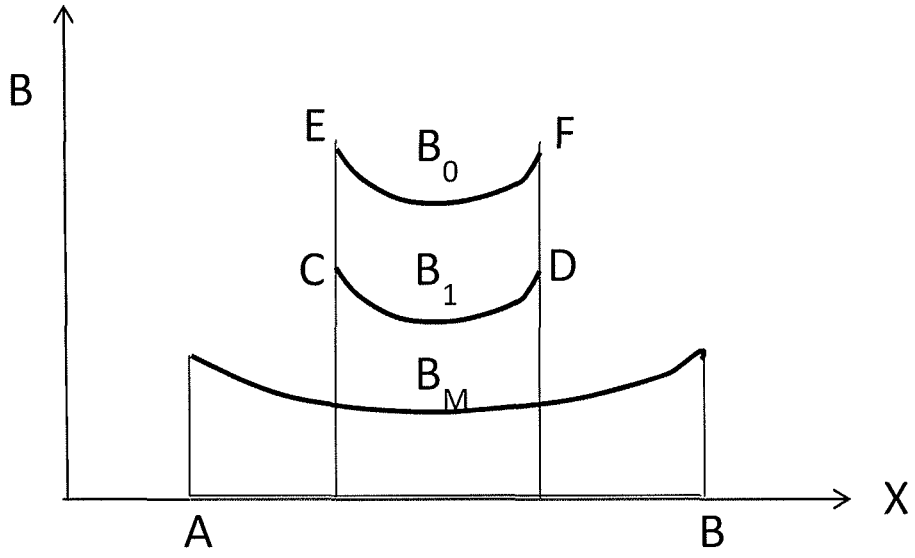
FIG. 9 illustrates the strength of the magnetic field along directions defined with reference to FIG. 8.

More detail on the central region of the cusp is given in FIG. 8. In that figure coils 10 and 20 correspond to those labeled 10 and 20 in FIG. 7. The magnetic field variation along lines AB, CD and EF of FIG. 8 is shown qualitatively in FIG. 9 where X represents distance along the labeled lines. The field within coil 10 has value $B_0$ lying on axis 1 between points E and F, and the field within coil 20 has value $B_1$ on axis 1 between points C and D.

Values $B_0$ and $B_1$ both exceed the lowest radial magnetic field $B_M$ between A and B. When the cusp axial fields both exceed its radial field in this manner, then plasma leakage dominates at the circle of positions defined by all possible locations of the lowest field point on line AB around rotation axis 1. Plasma outflow from this locus then follows radial field lines toward (and between) coils 30 and 40.

Figure 10:
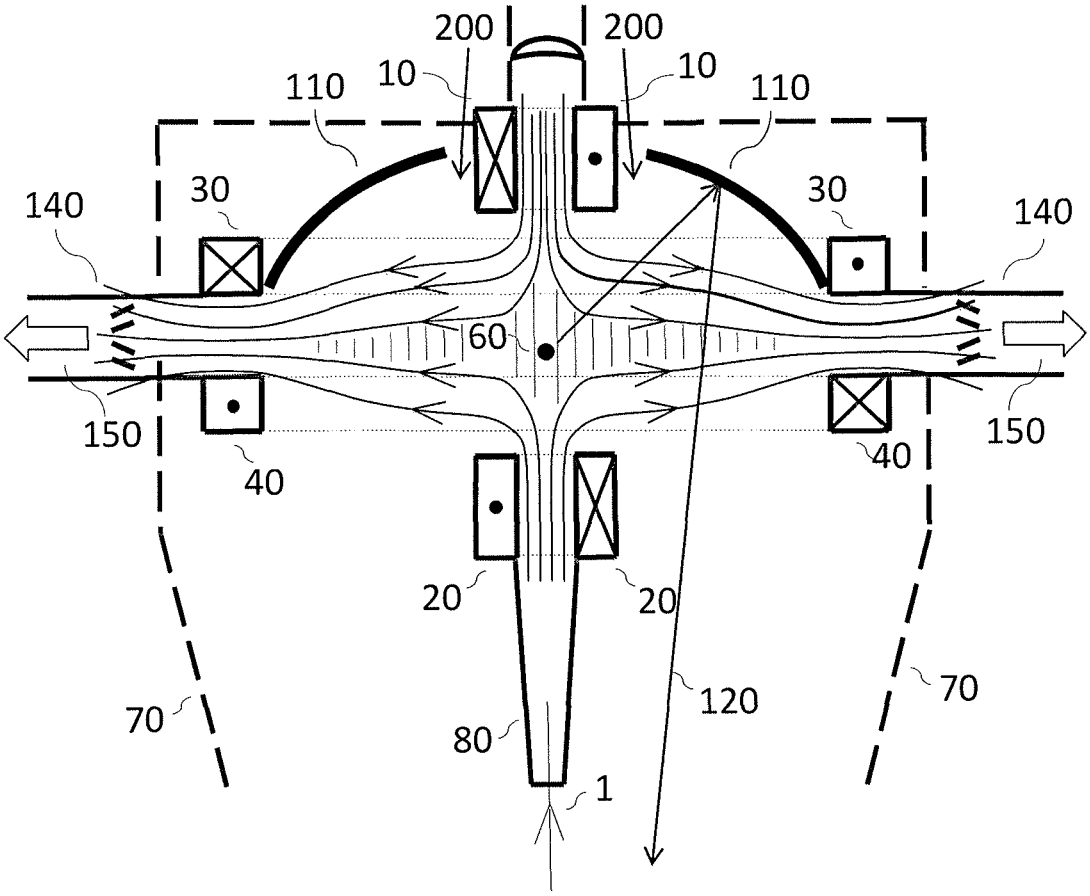
FIG. 10 shows a realization of the invention in which the cusp field is near-symmetric, having its lowest field barrier in the radial direction.

One embodiment of the near-symmetrical cusp system is illustrated in FIG. 10 in which magnetic field lines guide the plasma (vertically shaded) from interaction region 60 toward plasma beam dumps 140 arranged azimuthally around chamber 70. The laser-plasma interaction takes place at or near to the null magnetic field point 60 which is now closer to coil 20 than to coil 10 for the case illustrated in which coil 10 generates a higher field than coil 20. For clarity in FIG. 10, the droplet generator and droplet capture device are not shown, but instead we show the majority configuration which is an annular plasma beam dump 140 leading into vacuum pumps 150. Smaller items such as the droplet generator and laser beams for droplet measurement are interspersed between the larger plasma dump elements and may be protected from the plasma heat and particle flux by local field-shaping coils or magnetic elements, discussed below in relation to FIG. 12.

A buffer gas chosen from the set hydrogen, helium and argon is flowed through the chamber at a density sufficient to slow down fast ions from the laser-plasma interaction, but not absorb more than 50% of the extreme ultraviolet light as it passes from the plasma region to an exit port of the chamber. Absorption coefficients for these gases are discussed in [15]. An argon buffer is preferred for the reasons discussed, and typically may be provided in the density range between $1\times10^{15}$ and $4\times10^{15}$ atoms $cm^{-3}$.

In operation, this embodiment has a stream of argon atoms 200 entering for example through the gap between coil 10 and collection optic 110, to establish an argon atom density of approximately $2\times10^{15}$ atoms $cm^{-3}$ in front of collection optic 110. A stream of droplets is directed toward region 60 and irradiated by one or more laser pulses to generate EUV light. Plasma ions from the interaction can have an energy up to 5 keV [14] and are slowed down by collisions with argon atoms at the same time as they are directed in curved paths by the cusp field, with the result that a thermalized plasma, more than 99.9% argon and less than 0.1% tin ions, accumulates in the cusp central region. After a short period of operation (less than $10^3$ sec) the accumulated thermal plasma density, and by implication its pressure, exceeds the pressure of the containment field $B_M$ at the waist of the cusp (discussed above in relation to FIGS. 7 and 8). Plasma then flows toward beam dumps 140 guided by the outer cusp magnetic field. In order to contain the argon plasma density of approximately $10^{15}$ atoms/ions $cm^3$ at a temperature of 1.5 eV, the minimum cusp confinement magnetic field has a value in the range 0.01-1.0 Tesla. In a preferred configuration the minimum cusp confinement magnetic field has a value in the range 50 mT to 200 mT.

The presence of a plasma flow causes neutral argon atoms to be entrained in the flow, and pumped effectively into beam dumps 140 and vacuum pumps 150. The plasma is more than 99.9% argon when tin droplet size of 20 micron diameter is used at a repetition frequency of 100 kHz as discussed above.

Figure 11:
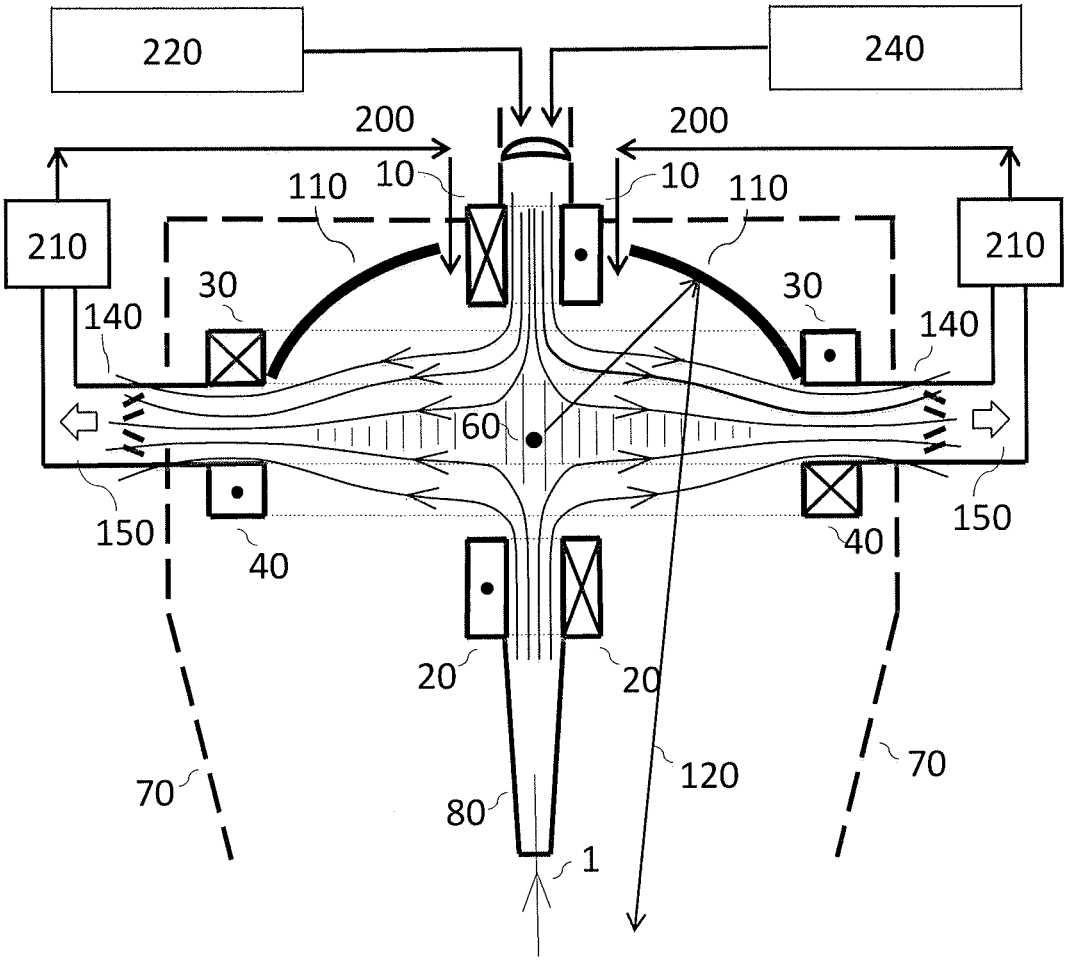
FIG. 11 illustrates certain system elements including a plurality of lasers and a buffer gas return flow loop.

System elements of the above embodiments are drawn in FIG. 11. In general a plurality of laser systems 220, 240 etc. are directed via a lens or lenses toward the interaction region 60 within chamber 70. The buffer gas that is exhausted via beam dumps 140 and vacuum pumps 150 is cleaned and pressurized in gas reservoirs 210. As needed, gas is flowed via tubes 200 to be re-injected into the chamber at a typical location between coil 10 and collection optic 110.

Figure 12:
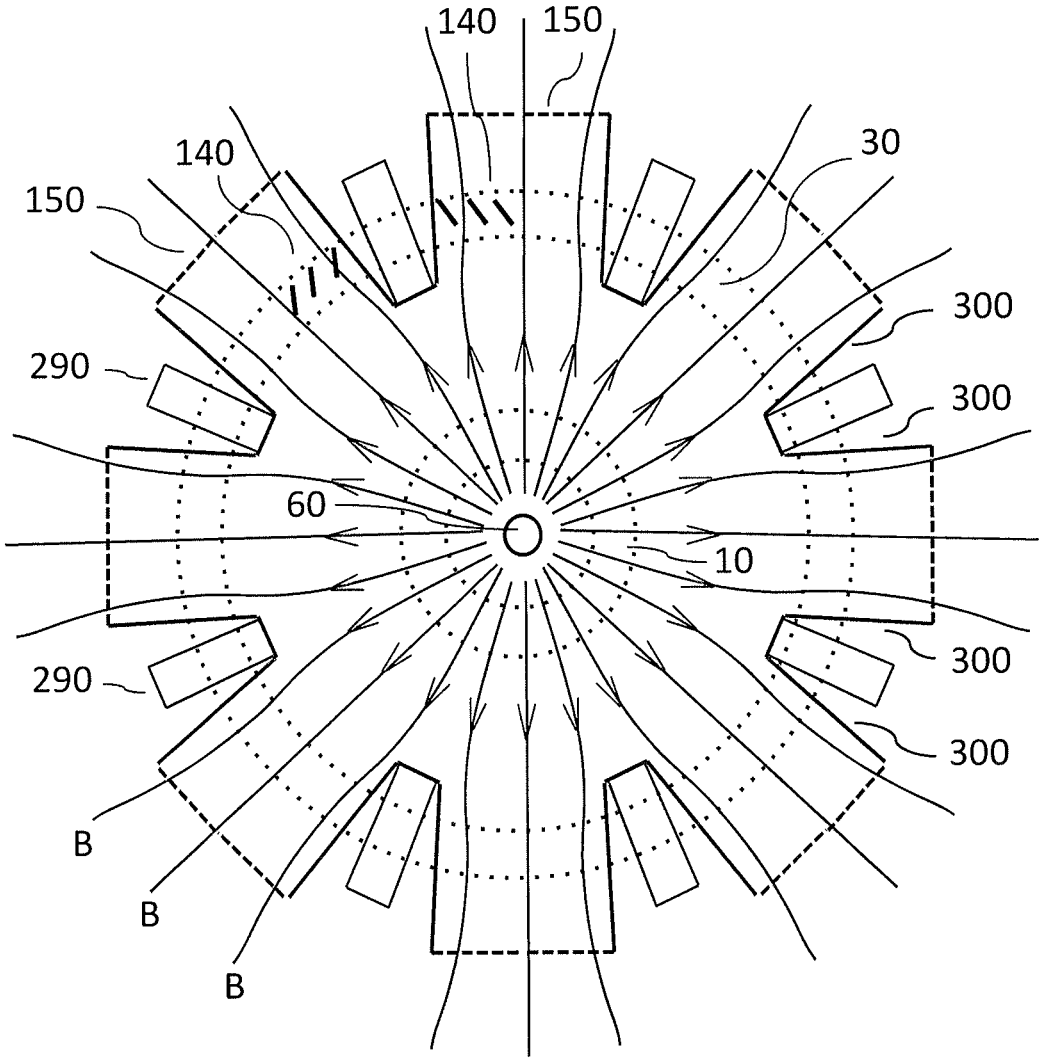
FIG. 12 shows a cross section in the plane that is perpendicular to the optical axis and contains the interaction region, with additional system elements including the annular array of plasma beam dumps, the vacuum pumps and droplet injection and diagnostics ports.

Additional system elements of the above embodiments are drawn in FIG. 12. This figure depicts a cross section of the system in a plane perpendicular to axis of symmetry 1 that is illustrated for example in FIG. 11. This plane includes the interaction location 60. Lines of magnetic force B run radially in this view. The flux lines are guided into beam dumps 140 and vacuum pumps 150 by elements 300 that may either be small antiparallel field coils, magnetic shield material, or a combination thereof. The "annular beam dump" is in practice divided into a plurality of elements 140 that are arranged in the plane perpendicular to the axis of symmetry that contains position 60. This division is for two main reasons: a) vacuum pump flanges are usually round, so they cannot be positioned without gaps so as to pump at all locations around a continuous annular beam dump; and b) there has to be access in this plane for the droplet stream and for optical systems that detect droplet position. All of these sub-systems may access interaction region 60 via ports 290 that are shielded from the ion flux by field-shaping elements 300.

Further realizations of the invention will be apparent to those skilled in the art and such additional embodiments are considered to be within the scope of the following claims.

REFERENCES

1. "EUV Sources for Lithography" Ed V. Bakshi, SPIE Press, Bellinghaven, Wash. 2005.
2. U.S. Pat. No. 7,479,646 McGeoch, Jan. 20, 2009
3. U.S. Pat. No. 8,269,199 McGeoch, Sep. 18, 2012
4. U.S. Pat. No. 8,440,988 McGeoch, May 14, 2013
5. U.S. Pat. No. 8,569,724 McGeoch, Oct. 29, 2013
6. U.S. Pat. No. 8,592,788 McGeoch, Nov. 26, 2013
7. M. McGeoch Proc. Sematech Intl. EUV Lithography Symp., Toyama, Japan 28 Oct. 2013
8. M. Richardson et al., J. Vac. Sci. Tech. 22, 785 (2004)
9. Y. Shimada et al., Appl. Phys. Lett. 86, 051501 (2005)
10. S. Fujioka et al., Phys. Rev. Lett. 95, 235004 (2005)
11. S. Fujioka et al., Appl. Phys. Lett. 92, 241502 (2008)
12. H. Mizoguchi et al, Proc SPIE 2014
13. D. Brandt et al., Proc SPIE 2014
14. S. S. Harilal et al., Phys. Rev. E69 026413 (2004)
15. S. S. Harilal et al., Appl. Phys. B86, 547-553 (2007)
16. U.S. Pat. No. 7,271,401 Imai et al., Sep. 18, 2007
17. U.S. Pat. No. 7,705,533 Komori et al., Apr. 27, 2010
18. U.S. Pat. No. 7,999,241 Nagai et al, Aug. 16, 2011
19. U.S. Pat. No. 8,143,606 Komori et al., Mar. 27, 2012
20. U.S. Pat. No. 8,492,738 Ueno et al., Jul. 23, 2013
21. U.S. Pat. No. 8,507,883 Endo et al., Aug. 13, 2013
22. U.S. Pat. No. 8,569,723 Nagai et al., Oct. 29, 2013
23. U.S. Pat. No. 8,586,953 Komori et al., Nov. 19, 2013
24. U.S. Pat. No. 8,586,954 Asayama et al., Nov. 19, 2013
25. U.S. Pat. No. 8,629,417 Nagai et al., Jan. 14, 2014
26. U.S. Pat. No. 8,710,475 Komori et al., Apr. 29, 2014
27. U.S. Pat. No. 8,519,366 Bykanov et al., Aug. 27, 2013
28. US Pat Appl. 20140021376 Komori et al. date
29. US Pat Appl. 20110170079 Banine et al, Jul. 14, 2011
30. U.S. Pat. No. 7,271,401 Imai et al., Sep. 18, 2007
31. U.S. Pat. No. 7,705,533 Komori et al., Apr. 27, 2010
32. U.S. Pat. No. 7,671,349 Bykanov et al., Mar. 2, 2010
33. U.S. Pat. No. 8,198,615 Bykanov et al., Jun. 12, 2012

The invention claimed is:

1. An extreme ultraviolet light source comprising: a chamber; a source of droplet targets; one or more lasers focused onto the droplets in an interaction region; a flowing buffer gas; one or more reflective collector elements to redirect extreme ultraviolet light to a point on the common collector optical axis which is an exit port of the chamber; an annular array of plasma beam dumps disposed around the collector optical axis; a magnetic field provided by two sets of opposed, symmetrical field coils that carry equal but oppositely directed currents to create a symmetrical magnetic cusp, wherein the laser-plasma interaction takes place at or near the zero magnetic field point of the cusp and heat is removed via radial plasma flow in a 360 degree angle range perpendicular to the optical axis toward the annular array of plasma beam dumps.

2. An extreme ultraviolet light source as in claim 1 in which a buffer gas chosen from the set hydrogen, helium and argon is flowed through the chamber at a density sufficient to slow down fast ions from the laser-plasma interaction, but not absorb more than 50% of the extreme ultraviolet light as it passes from the plasma region to an exit port of the chamber.

3. An extreme ultraviolet light source as in claim 2 in which an argon buffer is provided in the density range between $1\times10^{15}$ and $4\times10^{15}$ atoms $cm^{-3}$.

4. An extreme ultraviolet light source as in claim 1 in which the minimum cusp confinement magnetic field has a value in the range 0.01-1.0 Tesla.

5. An extreme ultraviolet light source as in claim 1 in which the minimum cusp confinement magnetic field has a value in the range 50 mT to 200 mT.

6. An extreme ultraviolet light source comprising: a chamber; a source of droplet targets; one or more lasers focused onto the droplets in an interaction region; a flowing buffer gas; one or more reflective collector elements to redirect extreme ultraviolet light to a point on the common collector optical axis which is an exit port of the chamber; an annular array of plasma beam dumps disposed around the collector optical axis; a magnetic field provided by two sets of opposed, near-symmetrical field coils that carry oppositely directed currents to create a near-symmetrical magnetic cusp, wherein the laser-plasma interaction takes place at or near the zero magnetic field point of the cusp and heat is removed via radial plasma flow in a 360 degree angle range perpendicular to the optical axis toward the annular array of plasma beam dumps.

7. An extreme ultraviolet light source as in claim 6 in which a buffer gas chosen from the set hydrogen, helium and argon is flowed through the chamber at a density sufficient to slow down fast ions from the laser-plasma interaction, but not absorb more than 50% of the extreme ultraviolet light as it passes from the plasma region to an exit port of the chamber.

8. An extreme ultraviolet light source as in claim 7 in which an argon buffer is provided in the density range between $1\times10^{15}$ and $4\times10^{15}$ atoms $cm^{-3}$.

9. An extreme ultraviolet light source as in claim 7 in which the minimum cusp confinement magnetic field has a value in the range 0.01-1.0 Tesla.

10. An extreme ultraviolet light source as in claim 7 in which the minimum cusp confinement magnetic field has a value in the range 50 mT to 200 mT.

* * * * *